United States Patent [19]

Stefan

[11] 4,158,244

[45] Jun. 19, 1979

[54] POOL LINER RETAINER

[75] Inventor: Gunter Stefan, Toronto, Canada

[73] Assignee: Timerax Holdings Ltd., Georgetown, Canada

[21] Appl. No.: 825,874

[22] Filed: Aug. 18, 1977

[30] Foreign Application Priority Data

Jul. 20, 1977 [CA] Canada ..... 283115

[51] Int. Cl.[2] ..... E04H 3/16

[52] U.S. Cl. ..... 4/172.21; 160/391; 248/273; 24/243 K

[58] Field of Search ..... 160/395, 391, 371; 24/243 K; 248/273; 4/172, 172.21

[56] References Cited

U.S. PATENT DOCUMENTS

| | | | |
|---|---|---|---|
| 2,914,776 | 12/1959 | Hotz | 4/172 |
| 3,060,455 | 10/1962 | Lamb | 4/172 |
| 3,177,501 | 4/1965 | Kwake | 4/172 |
| 3,347,006 | 10/1967 | Fox | 52/300 |
| 3,427,663 | 2/1969 | O'Connell et al. | 4/172.21 |
| 3,477,190 | 11/1969 | Wood | 52/718 |
| 3,478,370 | 11/1969 | Stern | 4/172 |
| 3,851,848 | 12/1974 | Wiele | 160/391 X |

FOREIGN PATENT DOCUMENTS

| | | | |
|---|---|---|---|
| 196930 | 7/1938 | Switzerland | 160/395 |
| 16660 of | 1889 | United Kingdom | 160/395 |

*Primary Examiner*—Harry N. Haroian
*Attorney, Agent, or Firm*—Moss, Bensette

[57] ABSTRACT

A pool liner retainer is disclosed for holding or retaining the top peripheral edge portion or liner bead of a watertight pool liner, such as is used in swimming pool construction. The liner retainer includes an elongate retaining element defining a holding channel for accommodating the liner bead, a longitudinal outward slot communicating with the holding channel, and a longitudinal hinge channel located adjacent to the slot. An elongate closing element depends from the hinge channel to partially close the slot to retain the liner bead therebehind. The closing element is hinged for transverse inward movement to open the slot for insertion of the liner bead, and is biased for transverse outward movement to close the slot. Stop means are provided for preventing outward movement of the closing element into the slot by outward movement of the liner bead located in the holding channel.

5 Claims, 5 Drawing Figures

POOL LINER RETAINER

This invention relates to devices for retaining the top peripheral edge portion of a watertight liner as used in the construction of a swimming pool or the like.

It has become very common in recent years to manufacture or construct swimming pools, or other pools or ponds, by constructing fixed walls and a secure bottom or floor of the pool, which are not watertight, but which have sufficient structural strength to contain the water or other liquid with which the pool is filled. Pool liners are then used to make the pools watertight, and these liners usually consist of a watertight envelope made of waterproof sheet material, such as vinyl. The vinyl liner is dimensioned to conform to the shape of the structural walls and floor of the pool. The vinyl liner therefore has a top peripheral edge portion that corresponds with or is located adjacent to the top peripheral edge of the structural walls of the pool.

It is necessary to attach the top peripheral edge portion of the pool liner to the top peripheral edge of the structural pool walls in order to ensure that the liner does not slip down below the water line and thus allow water to get between the pool liner and the structural wall. Of course, if this happens, the water would leak out of the pool and defeat the purpose of the liner.

Various methods have been used in the past to attach the top peripheral edge portion of the liner to the top peripheral edge of the structural pool walls, and most of them have involved the use of some type of coping member which also finishes and rounds the top peripheral edge of the pool for safety and attractive appearance. One common method of retaining the pool liner is to incorporate a groove or slot into the coping. A thickened bead is formed on the top peripheral edge portion of the liner, and this bead is located in the coping slot. The coping slot generally has a longitudinal flange adjacent to the mouth or opening of the slot which engages a corresponding flange or lip in the thickened liner bead, and this is supposed to retain the liner peripheral edge. The coping slot is generally disposed at an angle such that the pull on the pool liner caused by the weight of the water in the pool tends to cause the liner bead to bind in the coping slot and thus help prevent the liner from becoming detached from the coping.

A difficulty with such prior art methods of retaining the liner is that in order to insert the liner bead into the coping slot, the bead and slot must be dimensioned loosely, with the result that the liner often pulls out of the coping slot. If this happens after the pool has been filled, the liner usually cannot be reinserted into the coping without draining the pool. It makes it very difficult to initially position the liner and fill the pool, if the liner has a tendency to pull out of the coping easily.

In the present invention, a very simple structure is shown for positively retaining the top peripheral edge portion of the pool liner, with a much reduced tendency for the pool liner to pull out of the liner retainer.

According to the present invention, there is provided a pool liner retainer having an elongate retaining element defining a holding channel adapted to accommodate a liner bead. The retaining element also defines a longitudinal outward slot communicating with the holding channel for insertion of the liner bead into the holding channel. The retaining element also defines a longitudinal hinge channel located adjacent to the slot and communicating with the holding channel. An elongate closing element depends from the hinge channel to partially close the longitudinal slot, the closing element being hinged for transverse inward movement to open the slot to permit insertion of the liner bead past the closing element. Means is provided for biasing the closing element toward the slot to retain an inserted liner bead behind the closing element. Also, stop means is provided to prevent the hinge closing element from moving outwardly into the slot by outward movement of the liner bead, so that the liner bead is removably held behind the closing element until the liner bead and closing element are moved inwardly to open the slot.

A preferred embodiment of the invention will now be described, by way of example, with reference to the accompanying drawings, in which.

Figure 1:
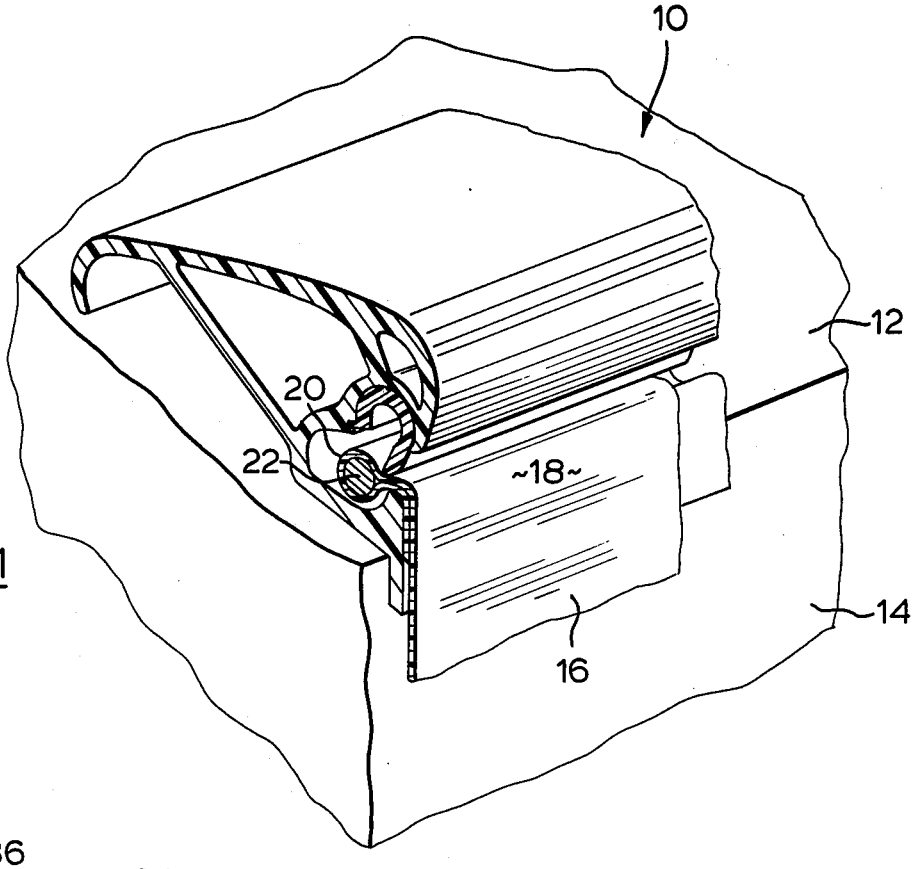
FIG. 1 is a perspective sectional view of the top peripheral edge portion of a swimming pool incorporating a preferred embodiment of a pool liner retainer according to the present invention.

Referring firstly to FIGS. 1 to 4, a pool liner retainer according to the present invention is generally indicated by reference numeral 10. Liner retainer 10 is shown mounted on a top peripheral edge portion 12 of a structural wall 14 of a swimming pool. Wall 14 shown in FIG. 1 is made of concrete, but it will be appreciated that wall 14 may be made of any other material or type of construction, as desired. A portion of a pool liner 16 is also shown in the drawings. Liner 16 is typically made of sheet vinyl material to form a watertight envelope conforming with the inside structural surfaces of the swimming pool. This type of liner construction is well known to those skilled in the art. However, liner 16 has a top peripheral edge portion 18 that includes a liner bead 20 that is formed by wrapping the marginal portions of the liner around a cord 22. The overlapping peripheral surfaces of the vinyl liner are then joined by a high frequency heat seal, or are adhesively bonded together as desired. Cord 22 may be formed of vinyl or any other type of relatively incompressible material.

Figure 2:
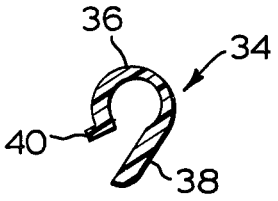
FIG. 2 is a sectional view of an insert used in the embodiment shown in FIG. 1.
Figure 3:
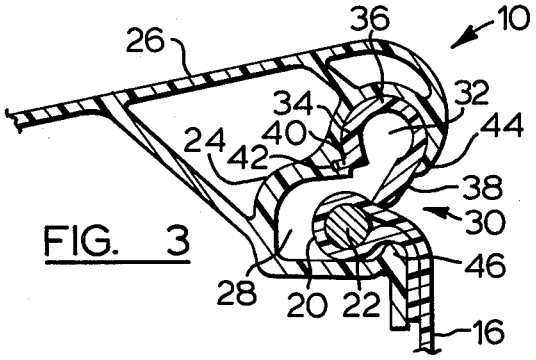
FIG. 3 is a partial transverse cross-sectional view of the embodiment shown in FIG. 1.
Figure 4:
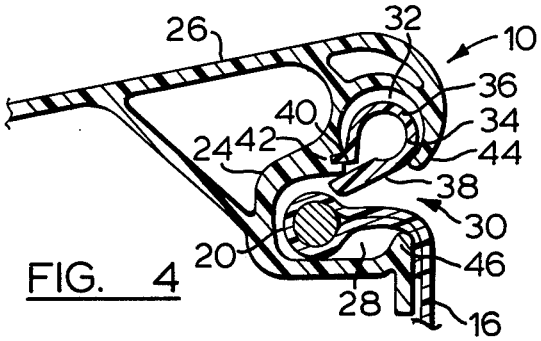
FIG. 4 is also a partial transverse sectional view similar to FIG. 3, but showing the insert deflected to allow the liner bead to be inserted or removed from the retaining element.

Referring in particular to FIGS. 2 to 4, pool liner retainer 10 includes an elongate retaining element 24 which is integrally formed as part of a coping 26. Retaining element 24 defines a holding channel 28 which is dimensioned to accommodate liner bead 20. Holding channel 28 is suitably dimensioned to permit insertion of liner bead 20, as best illustrated in FIG. 4. Retaining element 24 also defines a longitudinal outward slot 30 communicating with holding channel 28 through which liner bead 20 is inserted into retaining element 24.

Retaining element 24 also defines a longitudinal hinge channel 32 located adjacent to outward slot 30 and communicating with holding channel 28. A longitudinal insert 34 is longitudinally slidably located in hinge channel 32. Insert 34 is generally U-shaped having a rounded or circular base 36 and a longer outward leg depending from hinge channel 32 forming a closing element 38. Insert base 36 also includes a longitudinal rib 40 which is located for pivotal engagement in a longitudinal locating groove 42 in the wall of hinge channel 32 remote for closing elements 38. Rib 40 and locating groove 42 are provided to resist rotation of insert 34 in hinge channel 32. It will be appreciated that hinge channel 32 is generally cylindrical to correspond with the shape of insert base 36. As shown in the drawings, the insert closing element 38 is thickened. Also, the insert base is thickened adjacent to longitudinal rib 40. Both of these thickened portions of insert 34 add additional strength to the insert where stresses are higher.

Insert 34 is formed of a resilient plastic material, such as polyvinyl chloride. Retaining element 24 and thus coping 26, is also formed of polyvinyl chloride in the preferred embodiment. These members are typically extruded and cut to standard lengths from 6 to 10 feet. Where it is desired to use retaining element 24 at rounded corners, suitable corner pieces may be extrusion moulded, or the retaining element may be bent into the desired rounded configuration. If required, suitable transverse relief cuts could be made in the retaining element, to facilitate bending, and in this case it may be preferable to use a separate rounded coping 26 in conjunction with the rounded retaining element 24.

To assemble retaining element 24, insert 34 is usually slid longitudinally into hinge channel 32 through an open end of retaining element 24. However, it is also possible to locate insert 34 in hinge channel 32 by inserting insert 34 through slot 30 and up into hinge channel 32. This is particularly useful where the pool liner retainer has previously been assembled and it is required to replace insert 34. In this case, the old insert 34 can be grasped by closing element 38 and pulled out of hinge channel 32 through slot 30, and the new insert 34 positioned in the hinge channel without having to disassemble the coping or the retaining element.

Referring in particular to FIG. 4, liner bead 20 is shown in the position where it can either be inserted or removed from retaining element 24. As shown, closing element 38 is hinged or deflected upwardly to permit transverse horizontal movement of liner bead 20. It will be appreciated that holding channel 28 is generally oblong in cross-section, the long axis of the oblong being horizontally disposed. The short axis width of the oblong holding channel is slightly larger than the width or diameter of the liner bead to permit closing element 38 to swing inwardly and upwardly as shown in FIG. 4. It will also be appreciated that closing element 38 is hinged for transverse inward movement to open slot 30 to permit insertion and removal of the liner bead, and that because insert 34 is formed of resilient plastic material, closing element 38 is biased ouwardly to hingeably move toward and partially close outward slot 30.

As seen best in FIG. 3, retaining element 24 also includes an outward peripheral longitudinal edge 44 which acts as a stop to prevent excessive outward movement of the hinged closing element 38 into slot 30, and thus opening of slot 30. Retaining element 24 also includes a lower outward longitudinal peripheral edge or flange 46 located opposite closing element 38 and upper peripheral edge 44. Flange 46 and upper peripheral edge 44 define the boundaries of slot 30. It is preferable that the spacing between flange 46 and upper peripheral edge 44 (or the width of slot 30) remain generally uniform and just sufficiently wide to permit insertion of the liner bead, even where retaining element 24 is bent around corners.

It will be appreciated from FIGS. 3 and 4, that liner bead 20 may be inserted into retaining element 24 simply by pushing the liner bead through slot 30 into holding channel 28 past closing element 38. When the bead is pushed far enough into holding channel 28, closing element 38 will spring or snap downwardly and outwardly to close slot 30. When the swimming pool is then filled with water to exert pulling forces on pool liner 16, liner bead 20 will move to the position shown in FIG. 3 behind closing element 38, and the closing element and flange 46 will prevent the liner bead from being pulled out of the retaining element. As will be apparent from the drawings, closing element 38 is downwardly and inwardly disposed, so that outward pulling forces on liner bead 28 will tend to be transmitted around the rounded base of insert 34, rather than acting as perpendicular transverse bending stresses on closing element 38, which could tend to distort the shape of insert 34.

Figure 5:
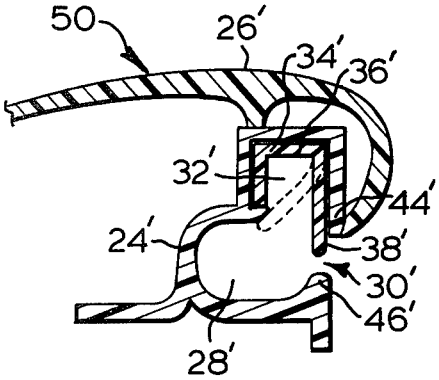
FIG. 5 is a partial sectional view similar to FIGS. 3 and 4, but showing a second embodiment of a pool liner retainer according to the present invention.

Referring next to FIG. 5, another embodiment of a retaining element is shown, primed reference numerals being used to indicate elements which are similar to those shown in the embodiment illustrated by FIGS. 1 to 4. The liner retainer shown in FIG. 5 is generally indicated by reference numeral 50 and includes a retaining element 24' and a coping 26' that are separate elements. A similar configuration could be used in connection with liner retainer 10 shown in FIGS. 1 to 4. Coping 26' could be any configuration desired, or it could be eliminated from liner retainer 50 if desired. Retaining element 24' is shown having a hinge channel 32' which is generally square in cross-section. A corresponding insert 34' is located in hinge channel 32'. Insert 34' has a generally square base 36', so that the square hinge channel 32' and base 36' tend to resist rotation of the insert in the hinge channel. Insert 34' also has a downwardly depending closing element 38' which partially closes slot 30'. Insert 34' is also formed of resilient plastic material such as polyvinyl chloride, so that closing element 38' is hinged for transverse inward movement and is biased for hinged transverse outward movement toward a stop defined by outward peripheral edge 44'.

Liner retainer 50 is used in a similar manner to liner retainer 10, with the insertion of a liner bead (not shown) causing closing element 38' to deflect inwardly as shown in dotted lines in FIG. 5. While closing element 38' is shown to be vertically disposed, it could also be downwardly and inwardly disposed similar to the embodiment shown in FIGS. 1 to 4.

Having described preferred embodiments of the invention, it will be appreciated that various modifications may be made to the structures described. For example, the insert could be other shapes than those having rounded or square bases, and for the purposes of this disclosure, the term cylindrical in reference to the insert bases or hinge channels shall include both circular and square configurations. Also other means could be used to resist the tendency of the inserts to rotate in the hinge channels. However, it is believed that better locating and spring action is achieved with the circular or round base configuration and this is also a stronger construction. It would be possible to eliminate the rib and locating groove in the rounded base insert embodiment if other biasing means is employed, because it would not matter if the insert rotated. The biasing means could be adapted to return the insert closing element to rest against the stop means to hold the liner bead in position.

The closing element of the insert is shown slightly downwardly and inwardly disposed in FIGS. 1 to 4, or perpendicular to the holding channel in FIG. 5, but the closing element could be slightly outwardly disposed as well. However, it is believed that this configuration would not be as strong as the other embodiments described.

Although in the preferred embodiments, polyvinyl chloride is used as the material for making the various members, it will be appreciated that other materials may be used as well. For example, the retaining element or the coping could be extruded from aluminum. Also, any other suitable plastic material could be used for the inserts. An example of another type of plastic material is a product referred to as DELRIN, which is a trade mark of E. I. Dupont de Nemours and Co. of Wilmington, Del., United States of America. DELRIN is an acetyl-resin type plastic with high fatique resistance and a generally uniform spring constant characteristics.

It is also possible that the inserts and retaining elements could be formed integrally as one piece with a suitable integral hinge attachment for the closing element. However, in the event that the insert should fail in use, it would be necessary to replace the whole retainer element, and possibly the whole coping. With a two-piece insert and retaining element, it probably would not be necessary to disassemble the coping to replace the insert, as mentioned above.

Finally, it will be appreciated that the liner bead could be constructed differently if desired.

The present invention provides a very simple but effective means of retaining the peripheral edge portion of a pool liner. The liner bead is held positively and cannot be dislodged by inadvertent shifting of the liner. However, the liner bead can be removed from the retainer simply by pushing the bead further into the retainer and deflecting the closing element upwardly using a suitable flat tool or the like.

What I claim is:

1. A pool liner retainer comprising: an elongate retaining element defining a holding channel adapted to accommodate a liner bead and a generally cylindrical hinge channel communicating with the holding channel, said hinge and holding channels defining a longitudinal outward slot for insertion of the liner bead into the holding channel;

an elongate U-shaped insert located in the hinge channel, the insert having an outward closing element depending from the hinge channel to partially close said slot and an inwardly disposed base; said base defining a longitudinal rib, and the hinge channel defining a locating groove, the rib being located in the groove to resist rotation of the insert in the hinge channel;

means for biasing the closing element toward said slot; and the hinge channel defining stop means engaging the closing element to prevent outward movement thereof into the slot, the insert thereby being inwardly hingeable for insertion of a liner bead and outwardly biased into engagement with the stop means to partially close the slot and retain the liner bead in the holding channel.

2. A pool liner retainer as claimed in claim 1 wherein said insert base and hinge channel are generally circular in cross-section.

3. A pool liner retainer as claimed in claim 2 wherein said insert is formed of resilient plastic material, and wherein the insert is formed with a thickened insert closing element, and wherein the insert base is thickened adjacent to said longitudinal rib.

4. A pool liner retainer comprising:

an elongate retaining element defining a holding channel adapted to accommodate a liner bead and a hinge channel communicating with the holding channel, said hinge and holding channels defining a longitudinal outward slot for insertion of the liner bead into the holding channel;

an elongate resilient U-shaped insert located in the hinge channel, the insert having a closing element depending from the hinge channel to partially close said slot and an inwardy disposed base pivotally engaging the hinge channel remote from the closing element; and the hinge channel defining stop means engaging the closing element to prevent outward movement thereof into the slot, the insert thereby being inwardly pivotable for insertion of a liner bead and outwardly biased into engagement with the stop means to partially close the slot and retain the liner bead in the holding channel.

5. A pool liner retainer as claimed in claim 4 wherein said insert base and hinge channel are generally circular in cross-section, the insert having a thickened insert closing element, and the insert base being thickened in the area of pivotal engagement with the hinge channel.

* * * * *